US005782019A

United States Patent [19]

Launder et al.

[11] Patent Number: 5,782,019

[45] Date of Patent: Jul. 21, 1998

[54] HIGH STRENGTH EARTH WORKING TOOTH

[75] Inventors: Brian L. Launder, Tulsa; Charles Clendenning, Broken Arrow, both of Okla.

[73] Assignee: H & L Tooth Company, Tulsa, Okla.

[21] Appl. No.: 564,899

[22] Filed: Nov. 29, 1995

[51] Int. Cl.[6] ..... E02F 9/28

[52] U.S. Cl. ..... 37/446; 37/453; 37/456

[58] Field of Search ..... 37/446, 448, 450, 37/452, 453, 455, 456; 403/374, 405.1; 172/750

[56] References Cited

U.S. PATENT DOCUMENTS

| | | | |
|---|---|---|---|
| 2,360,315 | 10/1944 | Campbell et al. . | |
| 2,762,139 | 9/1956 | Launder | 37/453 |
| 3,020,655 | 2/1962 | Launder | 37/453 |
| 3,624,827 | 11/1971 | Liess | 37/456 X |
| 3,729,845 | 5/1973 | Flippin | 37/142 |
| 3,805,423 | 4/1974 | Engel et al. | 37/453 |
| 3,959,901 | 6/1976 | Klett | 37/142 |
| 4,123,861 | 11/1978 | Hemphill | 37/195 |
| 4,136,469 | 1/1979 | Zepf | 37/141 |
| 4,231,173 | 11/1980 | Davis | 37/142 |
| 4,251,933 | 2/1981 | Hemphill | 37/141 |
| 4,321,762 | 3/1982 | Hemphill | 37/141 |
| 4,407,081 | 10/1983 | Hanson | 37/141 |
| 4,470,210 | 9/1984 | Hahn | 37/142 |
| 4,616,433 | 10/1986 | Knell et al. | 37/141 |
| 4,642,920 | 2/1987 | Lenhoff et al. | 37/141 |
| 4,748,754 | 6/1988 | Schwappach | 37/141 |
| 4,761,900 | 8/1988 | Emrich | 37/142 |
| 4,932,478 | 6/1990 | Jones | 37/456 X |
| 4,949,481 | 8/1990 | Fellner | 37/141 |
| 5,018,283 | 5/1991 | Fellner | 37/452 |
| 5,233,770 | 8/1993 | Robinson | 37/456 |

*Primary Examiner*—Dave W. Arola
*Assistant Examiner*—Robert Pezzuto
*Attorney, Agent, or Firm*—Rudnick & Wolfe

[57] ABSTRACT

An earth working tooth having a proximal end for attachment to an earth working machine and a distal end defining a forward cutting edge for penetrating the ground. The tooth has top and bottom surfaces having similarly curved configurations diverging angularly away from each other and extending longitudinally between the forward cutting edge and the proximal end of the tooth. The tooth further comprises parallel and generally vertical sidewalls extending between the top and bottom surfaces of the tooth. The top surface of the tooth is further provided with a depressed and changing configuration that inhibits the forward cutting edge from blunting as the tooth wears resulting from harsh work environments in which the tooth finds utility.

21 Claims, 3 Drawing Sheets

HIGH STRENGTH EARTH WORKING TOOTH

FIELD OF THE INVENTION

The present invention generally relates to excavating equipment and, more particularly, to an improved high strength excavating tooth for excavating or digging equipment.

BACKGROUND OF THE INVENTION

Excavating or digging teeth of the type which are the subject of the present invention are used in a number of earth working and mining machines such as, for example, scrapers, rippers, excavator buckets, rock buckets, and the like. Modern earth working machinery typically moves the bucket through an arcuate path of travel when digging. Moreover, such earth working machines typically arrange the excavating or digging teeth in side-by-side relation relative to each other across a front or forward edge of the equipment.

Typical excavating applications require the teeth on the bucket to penetrate and dig into extremely abrasive and rough materials. After penetrating and digging into the material to be excavated, the bucket is typically rolled up to load the materials into the bucket. As will be appreciated, a relatively high level of energy consumption is required to cause the digging or excavating teeth to penetrate and subsequently move through such rough materials.

Known digging teeth have a proximal end that is attached to the bucket and a distal end for penetrating the ground surface. It is known to provide the digging tooth with a slowly increasing cross-section between the distal and proximal ends thereof. As they are used, the thinner cross-section at the distal end of the tooth wears away during the usual rough uses to which the tooth is subjected. Accordingly, the front or penetrating end of the tooth becomes blunted. As well known in the art, a blunted front end on the tooth requires higher energy to penetrate and move through the ground than does a sharpened front end tooth.

Replacement of digging or excavating teeth across the front edge of the excavating equipment is a time consuming and labor intensive effort. Of course, during the time it takes to replace one or more digging teeth, the excavating equipment cannot be used for its intended purpose. Thus, replacement of worn or blunted excavating teeth can result in undue expense.

Accordingly, it is known to releasably mount the digging teeth to an adapter forwardly extending from a front edge of the excavating equipment. A resiliently biased locking pin typically passes through sidewalls of the tooth to releasably lock or secure the tooth to the adapter. To replace a blunted or broken tooth, the locking pin is slidably removed to allow a replacement tooth to be secured to the adapter. Furthermore, there is a loss of utility or actual economic loss incurred upon replacement of a blunted tooth since the costs of the remaining or throw away material associated with the worn or blunted tooth is not recoverable.

As will be appreciated, the spacing between adjacent teeth is minimized such that a maximum number of digging or excavating teeth can be arranged across a front edge of the excavating equipment. Typically, the spacing between adjacent teeth is such that only space for the locking pin to be slidably removed from the tooth is provided.

Thus, there is a need and a desire for a high strength earth working tool or tooth that is both high penetrating and self-sharpening to increase the efficiency of the digging tooth.

SUMMARY OF THE INVENTION

In view of the above, and in accordance with the present invention, there is provided an earth working tooth or tool having a proximal end for attachment to an earth working machine and a distal end defining a transverse forward cutting edge for penetrating the ground. The tooth has top and bottom surfaces having similarly curved configurations diverging angularly away from each other and extending longitudinally between the forward cutting edge and the proximal end of the tooth. The tooth further comprises parallel and generally vertical sidewalls extending between the top and bottom surfaces of the tooth. In a preferred form of the invention, the tooth is formed from forged alloy steel to promote its strength and longevity. Preferably, the top and bottom surfaces of the tooth have corresponding radii. The radii on the top and bottom surfaces of the tooth generally equal about twice the length of the tooth.

A salient feature of the present invention concerns configuring the top surface of the tooth to inhibit the forward cutting edge from blunting as the tooth wears resulting from harsh work environments in which the tooth finds utility. In a preferred form of the invention, the configuration provided on the top surface of the tooth has a changing profile as a function of the distance measured rearwardly from the distal or forward cutting edge of the tooth. As such, the tooth profile retains a substantially constant or slowly increasing cross-section as the tooth wears such that the tooth remains sharp enough to be useful even after considerable metal has been removed during the usual rough usage to with the tooth is subjected.

In a most preferred form of the invention, the sidewalls of the tooth have a generally convex configuration. Suffice it to say, the sidewalls of the tooth are configured such that the cross-section of the tooth is reduced as the tooth wears thereby allowing the tooth to continue to penetrate the ground surface without significantly increasing the power requirements to effect such penetration.

In accordance with another aspect of the present invention, the tooth is arranged in combination with an adapter to form an excavating tooth assembly. The adapter of the excavating tooth assembly has a rear portion for permitting connection of the tooth assembly to a bucket of an excavating machine or the like. The adapter further includes a nose region extending rearwardly from a forward end thereof In this embodiment of the invention, the excavating tooth has a transverse cutting edge at a forward end thereof for penetrating the ground and a socket at a rear end for permitting the tooth be coupled to and about the nose region of the adaptor. The excavating tooth has top and bottom surfaces with similarly curved configurations that diverge angularly away from each other and extend longitudinally between the forward cutting edge and a rear surface of the tooth. The tooth further comprises parallel and generally vertical sidewalls extending between the top and bottom surfaces of the tooth. The bottom surface of the tooth preferably includes a longitudinally extending web extending forwardly from a rear surface of the tooth for adding strength and durability to the tooth.

The tooth is releasably attached to the adapter using a locking mechanism comprising a generally elongated pin that passes endwise through the tooth and through a bore defined by the adapter. Preferably, the pin has an elongated elastomeric member fixedly disposed between generally arcuate and opposite surfaces for developing a wedging fit between the adapter and the tooth. The tooth defines a pair of aligned openings that releasably accommodate the locking pin.

In summary, the present invention provides a unitary excavating tooth having high strength characteristics and, because of its unique design, more easily penetrates the ground materials thereby increasing the efficiency of the apparatus to which it is attached. As will be appreciated, increasing penetration of the tooth in the ground surface likewise affects the energy consumption levels of the excavator apparatus to which the tooth is attached.

These and numerous other objects, aims and advantages of the present invention will become readily apparent in the following detailed description, the appended claims, and the following drawings.

DETAILED DESCRIPTION OF THE PRESENT INVENTION

Figure 1:
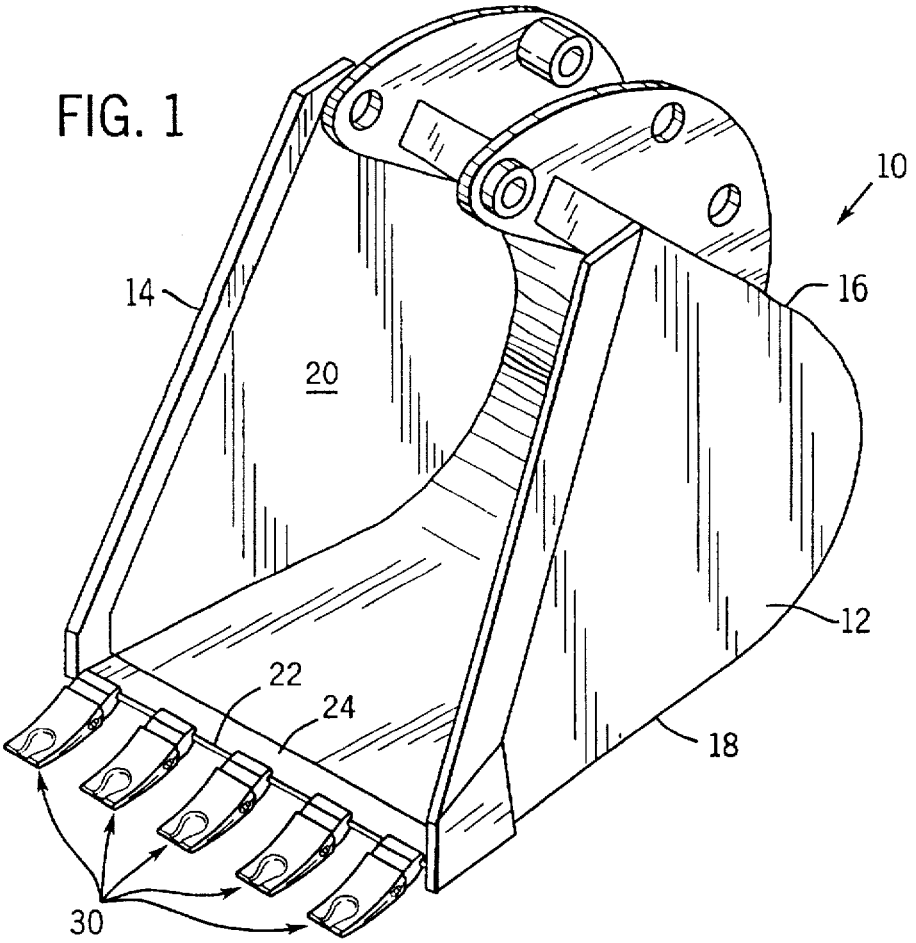
FIG. 1 is a perspective view of an excavating apparatus to which the tooth of the present invention is applied.

While this invention is susceptible of embodiment in various forms, there is shown in the drawings and will hereinafter be described in detail a specific embodiment with the understanding that the present invention is to be considered as an exemplification of the principles of the invention and is not intended to limit the invention to the specific embodiment illustrated.

Referring now to the drawings, wherein like reference numerals refer to like parts throughout the several views, and more particularly to FIG. 1, there is shown a perspective view of an excavating apparatus or bucket 10 that incorporates the principles of the present invention. In its illustrated embodiment, the excavating bucket or apparatus 10 includes two vertically disposed, spaced apart sidewalls 12 and 14 that are rigidly connected to each other by a rear wall 16 and a bottom wall 18 to form an outwardly opening, load receiving interior 20. Preferably, the sidewalls 12 and 14, rear wall 16 and bottom 18 are securely joined together by a conventional process such as welding. If desired, the back wall 16 of the bucket can be formed from two separate plates sandwiched together (a so-called double wrapper design). Notably, the bottom 18 of bucket 10 has a lip 22 (FIG. 3) at the leading marginal edge 24 thereof.

Figure 2:
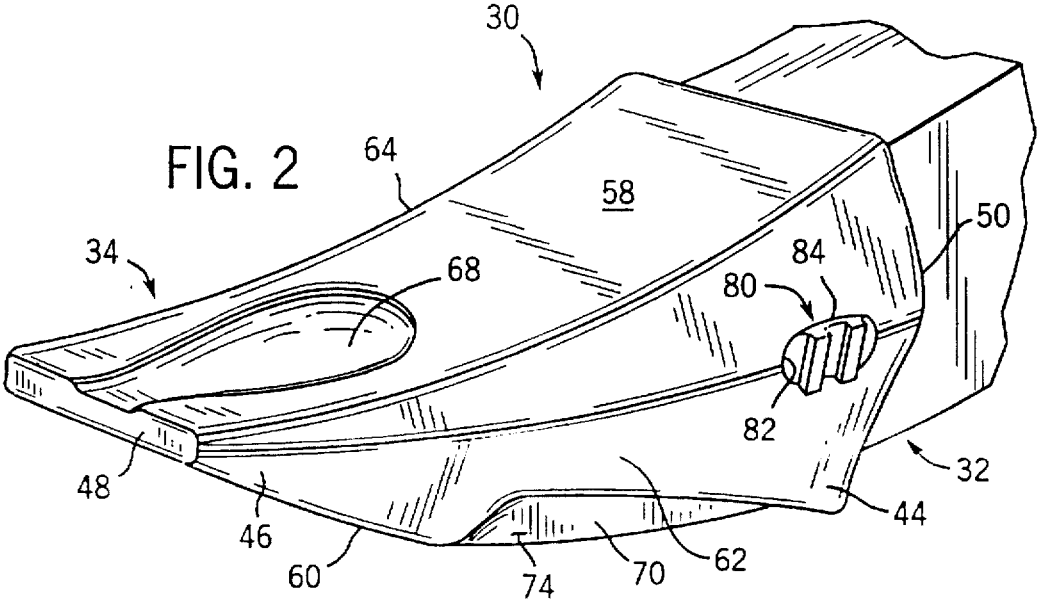
FIG. 2 is an enlarged prospective view of an excavating tooth according to the present invention.
Figure 3:
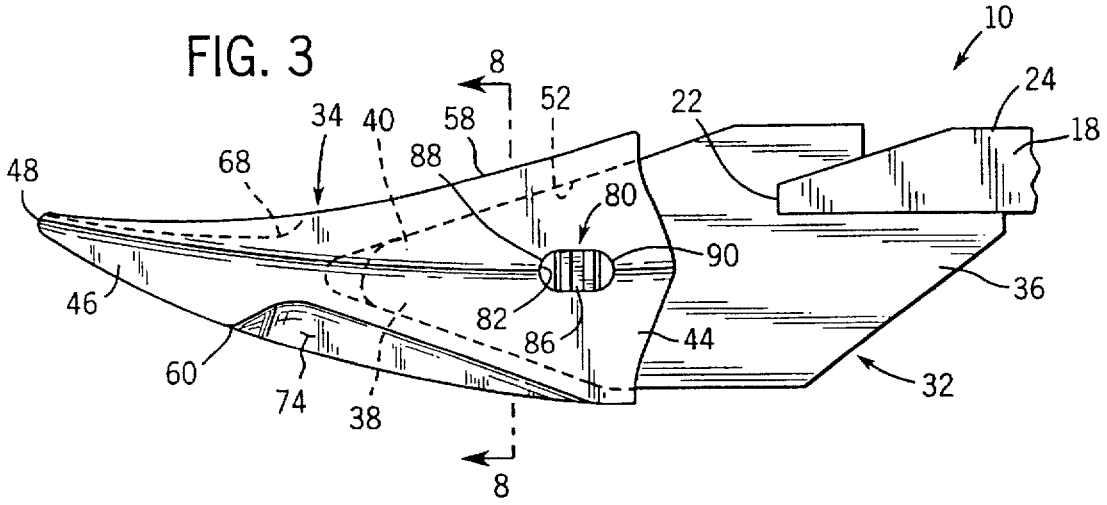
FIG. 3 is a side elevational view of the excavating tooth of the present invention.

The excavating apparatus or bucket 10, illustrated in FIG. 1, is provided with a plurality of excavating tools or tooth assemblies 30 that are disposed in side-by-side spaced relationship relative to each other across the forward or leading edge 24 to enhance the penetrating ability of the bucket 10 into the ground. As shown in FIGS. 2 and 3, each tool or tooth assembly 30 comprises an adapter 32 and an elongated excavating tooth or tool 34 and pin or other suitable locking apparatus.

The adapter 32 may be of any suitable type as well known in the art. Suffice it to say, the adapter 32 serves as a mount for the tool or tooth 34. As shown in FIG. 3, a proximal end 36 of the adapter 32 is secured in a conventional manner to the marginal edge 24 of the bucket and extends forwardly therefrom. As is typical, a nose region 38 extends rearwardly from a distal end 40 of the adapter 32.

To enhance the wearability thereof, the tooth 34 of each tooth assembly 32 is preferably formed from an alloy steel and is forged into the desired shape. Forging the tooth 34 into the desired shape advantageously produces directional grain characteristics which enhances the digging tooth's strength and resistance to impact and fatigue created by severe excavating conditions. The forging process creates a novel way of producing digging teeth and involves placing a steel billet, already exhibiting grain flow, in such a way to produce a tooth that upsets material at a 2300 Fahrenheit degree temperature. The grain flow direction will ensure maximum strength through design. In a most preferred form of the invention, the advantageous positioning of grain flow in the tooth 34 is achieved through no less than eight successive stages of production and is controlled by tooling design and in line inspections. Advantageously, the forged tooth can have approximately 30% greater strength as contrasted to a comparable or like cast tooth.

As shown in FIG. 3, the tooth 34 has a proximal end 44 for attachment to the excavating apparatus 10 (FIG. 1) and a distal end 46 defining a forward cutting edge 48 that extends transversely across the longitudinal axis or length of the tooth for penetrating the ground. In the illustrated embodiment, tooth 34 defines a generally vertical rear surface 50 with a blind cavity or socket 52 that opens to the rear surface 50. As shown in FIG. 3, socket 52 is configured to longitudinally accommodate a lengthwise portion of the nose region 38 of the mount or adapter 32.

Each tooth 34 has a top surface 58 and a bottom surface 60. The top and bottom surfaces 58 and 60, respectively, have similarly curved configurations each rearwardly extending from the cutting edge 48 to the rear surface 50 of the tooth 34. As shown in FIG. 3, and as they extend rearwardly from the cutting edge 48, the top and bottom surfaces 58 and 60 angularly diverge away from each other and toward the proximal end 44 of the tooth 34. In a preferred form of the invention, the top and bottom curved surfaces 58 and 60, respectively, have corresponding radii. In a most preferred form of the invention, the top and bottom surfaces each have a radius equal to about one-half the length of the tooth 34.

Figure 4:
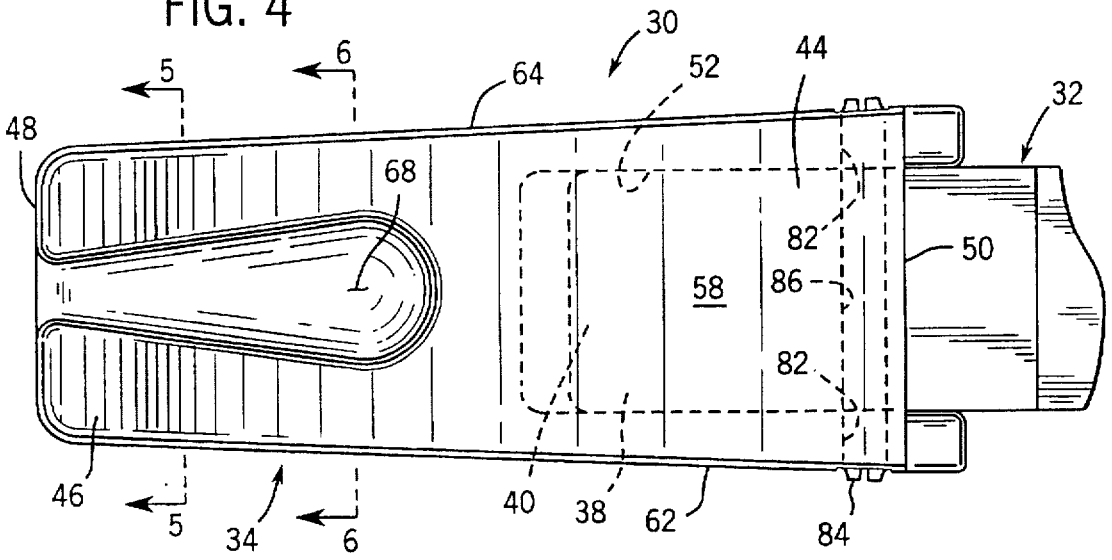
FIG. 4 is a top plan view of the excavating tooth of the present invention.
Figure 5:
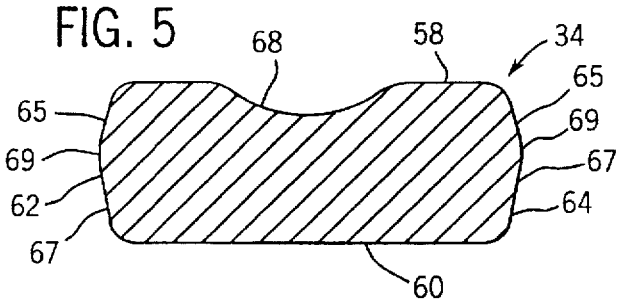
FIG. 5 is a sectional view taken along line 5—5 of FIG. 4.
Figure 6:
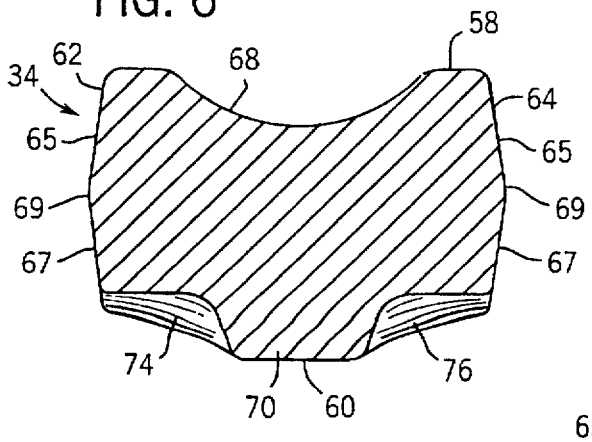
FIG. 6 is a sectional view taken along line 6—6 of FIG. 4.

As shown in FIGS. 2 and 4, tooth 34 further includes a pair of transversely spaced sidewalls 62 and 64 that extend between the top and bottom surfaces 58 and 60, respectively. As shown in FIGS. 4, 5 and 6 the sidewalls 62 and 64 are generally parallel to each other and extend generally vertical between the top and bottom surfaces 58 and 60, respectively.

In a most preferred from of the invention, and as shown in FIGS. 5 and 6, each sidewall 62, 64 has a convex configuration. As shown, each sidewall 62, 64 is preferably comprised of an upper vertical portion 65 and a lower vertical portion 67 that extend length of the respective sidewall 62, 64. The upper and lower vertical portions 65 and 67, respectively, of each sidewall 62, 64 are joined at an apex 69 that extends approximately midway between the top and bottom surfaces 58 and 60, respectively of the tooth 34. The vertical upper and lower portions 65 and 67, respectively, of each sidewall combine to define an included angle of about 166° therebetween. Preferably, the upper vertical portion 65 of each sidewall 62, 64 defines an included angle of about 97° relative to the upper surface 58 while the lower vertical portion 67 of each sidewall 62, 64 defines an included angle of about 97° relative to the lower surface 60 of the tooth 34.

Turning to FIG. 4, the top surface 58 of tooth 34 is specifically configured to inhibit the forward cutting edge 48 from blunting as the tooth 34 wears during the rough usage to which it is subjected. As shown, the top surface 58 of tooth 34 is configured with a depression 68 extending along the top surface 58 and rearwardly away from the front cutting edge 48. As shown in FIGS. 5 and 6, and to maintain the structural integrity and strength of the tooth 34, the depressed configuration 68 has a changing configuration as it extends rearwardly from the forward cutting edge 48 of the tooth As shown, the depression 68 is preferably configured as a concave depression that increasingly extends away from the top surface 58 as a function of the distance measured from the forward cutting edge 48. As shown, the depressional configuration 68 also widens as a function of the distance measured from the forward cutting edge 48 of the tooth 34. Preferably, the depression 68 extends rearwardly from the cutting edge 48 for a distance approximating about one-third to about one-half the length of the top surface 58.

Figure 7:
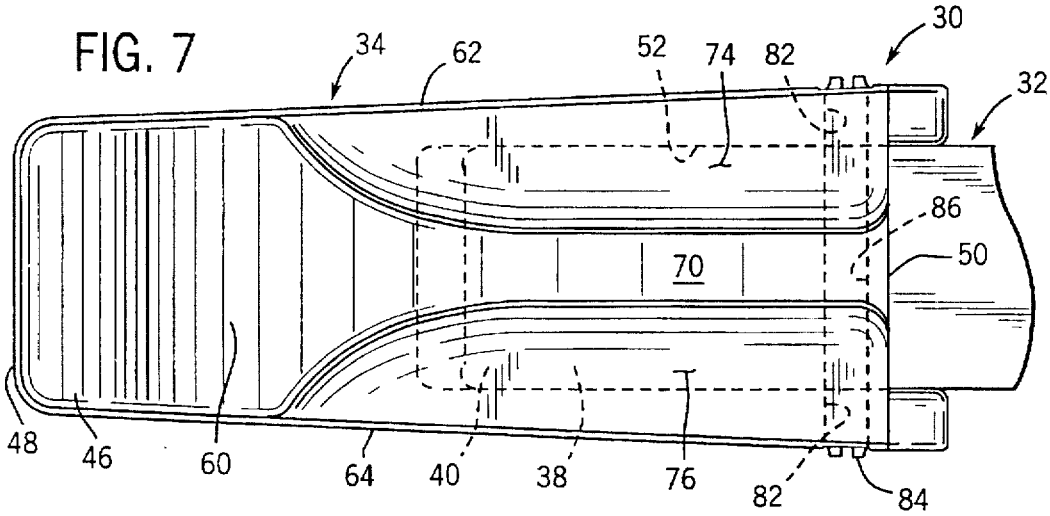
FIG. 7 is a bottom plan view of the excavating tooth of the present invention.
Figure 8:
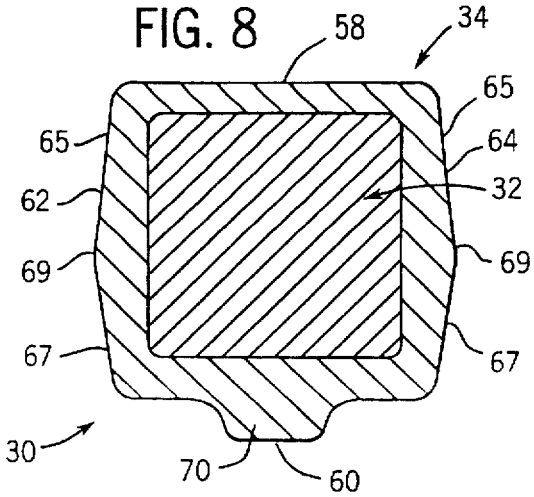
FIG. 8 is a sectional view taken along line 8—8 of FIG. 3.

Turning now to FIGS. 7 and 8, the underside or bottom surface 60 of tooth 34 includes a longitudinally extending web 70 to assure the high strength and structural integrity of the earth working tooth or tool 34. As shown, the web 70 is generally centralized between the sidewalls 62 and 64 and extends forwardly from the rear surface 50 of the tooth. The web 70 longitudinally extends forwardly from the rear surface 50 of the tooth for a distance approximating about one-half to about two-thirds the length of the bottom surface 60. Notably, and as shown in FIGS. 6 and 7, the undersurface of tooth 34 is configured such that generally equal and opposite recesses 74 and 76 are provided on opposite sides of the web 70. As shown, the recesses 74 and 76 diminish in cross-section between the distal end of the web 70 and that region wherein the web 70 meets the rear surface 50 of the tooth 34.

Returning to FIGS. 2 and 3, in a preferred form of the invention, each tooth 34 is releasably attached to the adapter 32 by a locking mechanism 80. In a preferred form of the invention, the sidewalls 62 and 64 of tooth 34 define a pair of axially aligned opening or slots 82 that open to the blind cavity 52. The slots 82 in the tooth 34 releasably accommodate an elongated locking pin 84 forming part of the locking mechanism 80. The elongated pin 84 passes endwise through the tooth 34 and a bore 86 (FIG. 4) defined toward the distal end 40 of the nose region 38 of the adapter 32 thereby releasably attaching the tooth 34 to the adapter 32. In a preferred form of the invention, and as shown in FIG. 3, the pin 84 has an elongated elastomeric member 86 fixedly disposed between generally arcuate and opposite surfaces 88 and 90 for developing a wedging fit between the tooth 34 and the adapter 32. It will be appreciated that in certain applications the openings or slots 82 are provided to releasably accommodate a vertically disposed pin 84.

As mentioned above, the tooth 34 of each tooth assembly 32 is preferably formed from an alloy steel that is forged into the desired shape. Forming the tooth 34 from an forged alloy steel has particular advantages when, and as shown in FIGS. 3 and 4, the tooth 34 is formed with a pair of axially aligned openings or slots 82 that open to the blind cavity 52. As is known in the art, forged metal has significantly greater strength characteristics than cast steel products. Accordingly, the life expectancy of the tooth is prolonged thus reducing the repair or replacement costs as well as reducing the utility or economic loss because there is less throw away material when replacement of the tooth 34 is required.

The preferred form of the present invention capitalizes on the increased strength afforded through the forging process by reducing the sidewall thickness in the area of the slots 82 as compared to like cast teeth. That is, and because, in a preferred form of the invention, the slots 82 extend through the sidewalls 62, 64, there is a significant stress concentration in this area. With digging or excavating teeth that are cast, the sidewall thickness in the area of the slots 82 must be increased to prevent failure resulting from stress fatigue and other related causes. With the preferred form of the present invention, however, the wall thickness in the area of the slots 82 does not have to be as thick as with like cast products due to the inherent strength of forged alloy steels.

The ability to lessen the sidewall thickness of the tooth yields several advantages. That is, lessening the sidewall thickness of the tooth reduces wasted materials in the form of throw away when the tooth requires replacement. Moreover, lessening the sidewall thickness of the tooth yields additional room on opposite sides of each tooth thereby facilitating removal and replacement of the locking pin. Minimizing the width of each tooth furthermore enhances the placement of the maximum number of excavating teeth across a forward edge of the excavating equipment using such teeth.

As will be appreciated by those skilled in the art, after the tooth is formed into its desired shape, the entire tooth is subjected to a heat treating and quenching or cooling process. With respect to the heat treating process, it is desired to avoid thick cross-sections of material since the desired microstructure transformation of the material for the tooth is dependent upon a rapid uniform cooling or quenching. The preferred form of the present invention accomplishes this and, thus, enhances overall strength of the tooth 34. The above-mentioned surface configurations on the top and bottom surfaces 58 and 60, respectively, of the tooth 34 offer benefits relating to the heat treating and cooling process associated with formation of the digging tooth 34. That is, the surface configuration 68 on the top surface 58 of the tooth 34 in combination with the generally centralized web 70 on the underside of the tooth 34 result in increased surface area and reduced cross-sectional thickness that maximizes the hardenability of the tooth achieved as a result of the heat treating and cooling process of the tooth 34.

During operation, the curved configuration on the top and bottom surfaces 58 and 60, respectively, facilitate penetration of the tooth 34 through the ground surface. To assure relatively easy and effective penetration of the tooth 34, the top surface 58 thereof is specifically configured with a depressed and changing contour 68 that inhibits blunting of the transverse cutting edge 48 as the tooth wears away so that the transverse cutting edge 48 remains still sharp enough to be useful even after considerable metal has been removed thus facilitating penetration of the tooth 34. Moreover, the raised ridge or web 70 on the underside or bottom surface 60 of the tooth 34 in combination with the vertical disposition of the sidewalls 62 and 64 promotes and reduces the power requirements for the tooth to penetrate and move through the ground surface.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. An elongated earth working tooth having a proximal end for attachment to an earth working machine and a distal end defining a forward cutting edge for penetrating the ground, said tooth having a top surface and a bottom surface, with said top and bottom surfaces having substantially similar curved configurations diverging angularly away from each other and extending longitudinally between the forward cutting edge and the proximal end of said tooth, and wherein the top surface of said tooth is provided with a changing configuration extending rearwardly from the forward cutting edge toward the proximal end to inhibit blunting of the forward cutting edge as the tooth wears, said tooth further comprising parallel and generally vertical sidewalls extending between the top and bottom surfaces of the tooth.

2. The earth working tooth according to claim 1 wherein said tooth is formed from forged metal materials to promote both strength and longevity for the tooth.

3. The earth working tool according to claim 1 wherein said top and bottom surfaces each have a radius equal to about twice the distance separating the proximal and distal ends of said tooth.

4. The earth working tool according to claim 1 wherein said tooth further defines a pair of aligned openings arranged toward the proximal end of said tooth.

5. A high strength excavating tooth having a forward cutting edge that extends generally transverse to a longitudinal axis defined by the tooth, said tooth comprising:

a top surface having a concave configuration extending rearwardly from the forward cutting edge for the length of said tooth;

a bottom surface having a curved configuration that is substantially similar to the top surface and extending rearwardly from the forward cutting edge for the length of the tooth and at an angled diverging disposition relative to said top surface, said bottom surface further including a single centrally disposed web longitudinally extending forwardly from a rear surface of the tooth to add strength and rigidity thereto and defining lengthwise elongated recesses opening to opposite sides of said tooth for facilitating penetration of said tooth into the ground;

two generally vertical sidewalls extending relatively parallel with each other and between said top and bottom surfaces of the tooth; and a rear portion extending between the top and bottom surfaces and the sidewalls for releasably mounting said excavating tooth to an excavating machine.

6. The excavating tooth according to claim 5 wherein the top surface of said tooth defines a concave depression having a changing profile for preventing the forward cutting edge of the tooth from blunting as the tooth wears resulting from use.

7. The excavating tooth according to claim 5 wherein the sidewalls of said tooth define a pair of axially aligned openings for releasably accommodating a pin of a locking mechanism that releasably mounts said tooth to said excavating machine.

8. The excavating tooth according to claim 5 wherein said top and bottom surfaces have a radius approximating twice the length of said tooth.

9. An excavating tooth assembly, comprising:

an adapter with a rear portion for permitting connection of said tooth assembly to a bucket of an excavating machine, and a nose region extending rearwardly from a forward end thereof;

an excavating tooth having a transverse cutting edge at a forward end thereof for penetrating the ground and a socket at a rear end for permitting said tooth to be coupled to and about the nose region of said adapter, said excavating tooth further having top and bottom surfaces with substantially similar curved configurations diverging angularly away from each other and extending longitudinally between the transverse cutting edge and a rear surface of said tooth, with the bottom surface of said tooth including a single centrally disposed web longitudinally extending forwardly from a rear end of the tooth to add strength and rigidity thereto and defining lengthwise elongated recesses opening to opposite sides of said tooth for facilitating penetration of said tooth into the ground, said tooth further comprising parallel and generally vertical sidewalls extending between the top and bottom surfaces of the tooth.

10. The excavating tooth assembly according to claim 9 wherein the top surface of said excavating tooth is configured such that the transverse cutting edge of said tooth is prevented from blunting as the tooth wears as a result of use.

11. The excavating tooth assembly according to claim 10 wherein the configuration on the top surface of said excavating tooth has a changing profile as a function of the distance measured rearwardly from the cutting edge of the tooth.

12. The excavating tooth assembly according to claim 11 further including a locking mechanism comprising a generally elongated pin that passes endwise through said tooth and a bore defined by said adapter such that said tooth is releasably attached to said adapter.

13. The excavating tooth assembly according to claim 12 wherein said pin has an elongated elastomeric member fixedly disposed between generally arcuate and opposite surfaces for developing a wedging fit between said adapter and said tooth.

14. The excavating tooth assembly according to claim 9 wherein said tooth defines a pair of aligned openings that releasably accommodate a locking pin of a locking mechanism that releasably attaches said tooth to said adapter.

15. The excavating tooth assembly according to 9 wherein the top and bottom surfaces of said tooth each have a radius equal to about twice the distance separating the front and rear ends of said tooth.

16. An excavating apparatus having sidewalls joined to a rear wall and to a bottom defining a lip to form an outwardly opening, load receiving interior, said bottom having a lip at a leading marginal edge thereof, and a plurality of digging teeth attached to and extending forwardly from said lip, each digging tooth comprising:

a mount secured to the marginal edge of said lip and extending forwardly therefrom, said mount including a forwardly projecting nose portion;

a relatively elongated and unitary member having a rear mounting end and a forward working end defining a cutting edge extending transversely across the forward working end of said member, the rear mounting end of said member having a socket that opens to a rear surface of said member and longitudinally accommodates the nose portion of said mount therein, said member further including top and bottom surfaces having substantially similar curved configurations diverging angularly away from each other and extending longitudinally between the forward working end and a rear surface defined at the rear mounting end of said member, with the curved bottom surface of said tooth generally following and forwardly extending the bottom of said bottom of said excavating apparatus, said member further including parallel and generally vertical sidewalls extending between the top and bottom surfaces; and a locking mechanism for releasably holding said member to said mount.

17. The excavating apparatus according to claim 16 wherein the curved configurations of said top and bottom surfaces of said member each have a radius approximating twice the separating the rear mounting end and the forward working end of said member.

18. The excavating apparatus according to claim 16 wherein said elongated member further defines a pair of axially aligned openings for accommodating a locking pin forming part of said locking mechanism.

19. The excavating apparatus according to claim 18 wherein said pair of aligned openings are defined by the sidewalls of said member.

20. The excavating apparatus according to claim 16 wherein the top surface of said member is configured with a depression arranged proximate to and having a changing cross-sectional configuration as the depression extends rearwardly from the forward cutting edge to inhibit the forward cutting edge from blunting as said member wears during use.

21. An excavating apparatus having sidewalls joined to a rear wall and to a bottom defining a lip to form an outwardly opening, load receiving interior, said bottom having a lip at a leading marginal edge thereof, and a plurality of digging teeth attached to and extending forwardly from said lip, each digging tooth comprising:

a mount secured to a marginal edge of said lip and extending forwardly therefrom, said mount including a forwardly projecting nose portion;

a relatively elongated and unitary member having a rear mounting end and a forward working end defining a cutting edge extending transversely across the forward working end of said member, the rear mounting end of said member having a socket that opens to a rear surface of said member and longitudinally accommodates the nose portion of said mount therein, said member further including top and bottom surfaces having substantially similar curved configurations diverging angularly away from each other and extending longitudinally between the forward working end and a rear surface defined by the rear mounting end of said member, with the curved bottom surface of said tooth generally following and forwardly extending the bottom of said bottom of said excavating apparatus, and wherein the bottom surface of said member further includes a single centrally disposed web longitudinally extending forwardly from a rear end of the member to add strength and rigidity thereto and defining lengthwise elongated recesses opening to opposite sides of said member for facilitating penetration of said member into the ground, said member further including parallel and generally vertical sidewalls extending between the top and bottom surfaces; and a locking mechanism for releasably holding said member to said mount.

* * * * *